United States Patent [19]

Peterson

[11] 4,361,737

[45] Nov. 30, 1982

[54] BASE STATION MICROPHONES

[75] Inventor: Donald W. Peterson, Conneaut, Ohio

[73] Assignee: The Astatic Corporation, Conneaut, Ohio

[21] Appl. No.: 177,113

[22] Filed: Aug. 11, 1980

[51] Int. Cl.[3] ..... H01H 9/02; H01H 9/26; H01H 13/70; H04R 1/02

[52] U.S. Cl. ..... 179/158 R; 179/147; 200/5 E; 200/18; 200/50 C; 200/334; 455/78

[58] Field of Search ..... 179/158 R, 147, 146 R, 179/178, 179, 1 SW, 167; 455/78, 92; 200/5 C, 5 B, 5 E, 321, 322, 334, 332, 335, 339, 18, 50 C

[56] References Cited

U.S. PATENT DOCUMENTS

| | | | |
|---|---|---|---|
| 1,424,809 | 8/1922 | Donle | 200/335 X |
| 2,557,351 | 6/1951 | Jacobson | 200/5 E X |
| 2,984,713 | 5/1961 | Swinehart | 179/167 |
| 3,511,951 | 5/1970 | Miller | 200/157 |

FOREIGN PATENT DOCUMENTS

| | | | |
|---|---|---|---|
| 686425 | 5/1964 | Canada | 200/5 E |
| 1158149 | 11/1963 | Fed. Rep. of Germany | 200/5 E |
| 564253 | 7/1975 | Switzerland | 200/339 |

OTHER PUBLICATIONS

Burstein-Applebee Catalog No. 641, 1963, p. 50.

*Primary Examiner*—Thomas W. Brown
*Attorney, Agent, or Firm*—Michael Williams

[57] ABSTRACT

A base station microphone with a transmit bar and a monitor button, the latter being operable to actuate a switch to check for a clear channel before transmitting. The present invention relates to a simple mechanical interlock between the monitor button and the transmit bar, wherein the monitor button must be depressed before the transmit bar may be actuated for transmission. The improved interlock comprises a bell crank lever that has a portion disposed to block depression of the transmit bar. When the monitor button is depressed, the bell crank lever is shifted to move said portion from its blocking position.

9 Claims, 14 Drawing Figures

FIG. 5.
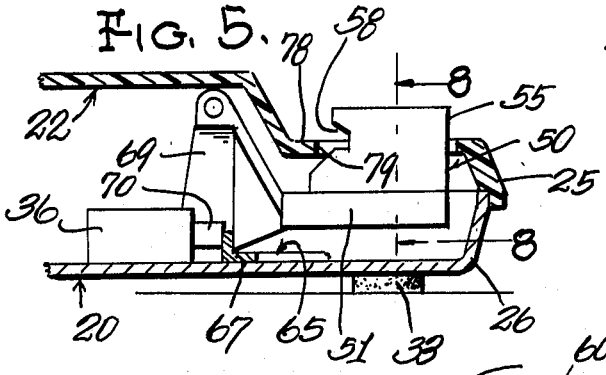
FIG. 6.
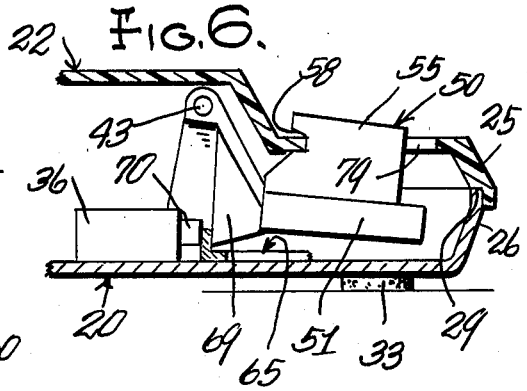
FIG. 9.
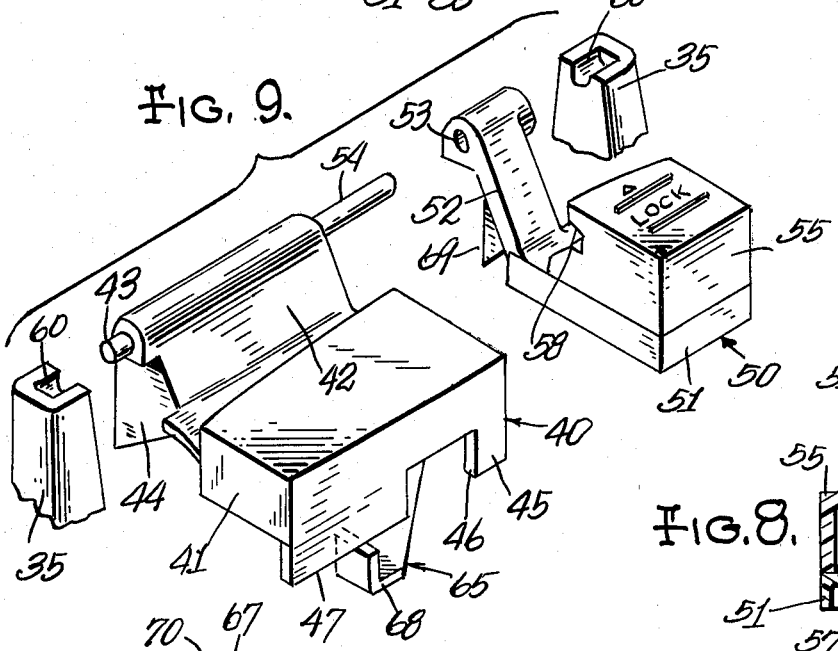
FIG. 7.
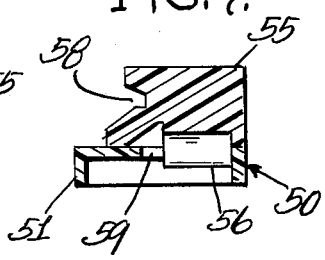
FIG. 8.
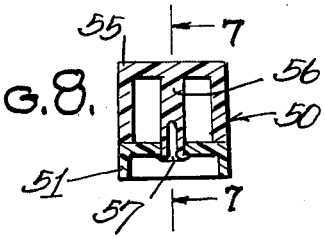
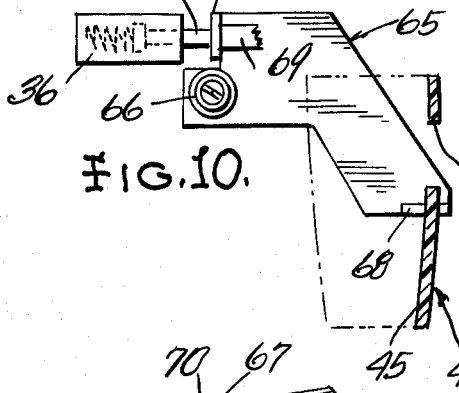
FIG. 10.
FIG. 12.
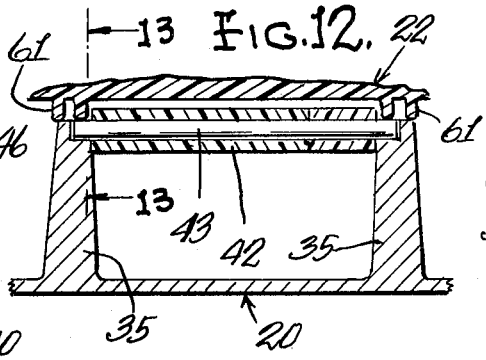
FIG. 13.
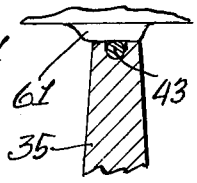
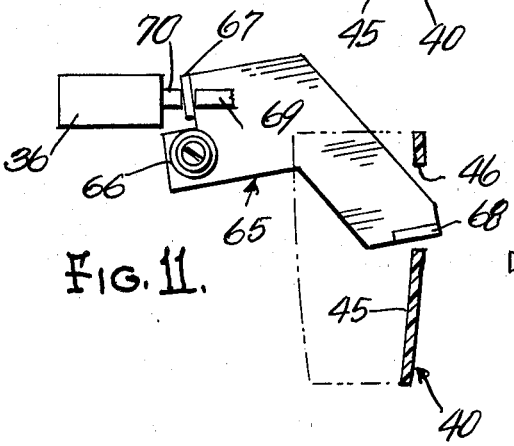
FIG. 11.
FIG. 14.
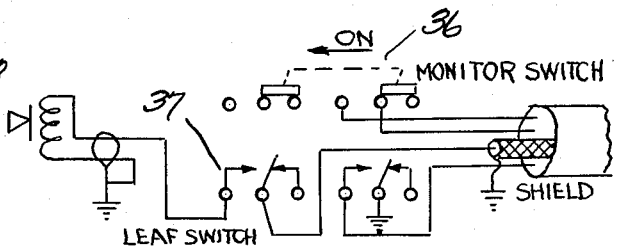

BASE STATION MICROPHONES

BACKGROUND AND SUMMARY

Interlocks between a transmit bar and a monitor button are known in the prior art, but are complex and subject to maintenance problems. A prior art presently known to me comprises a coiled spring having one end anchored to the microphone base and an opposite end in the form of a rectilinear leg which extends tangentially from the coil and blocks downward movement of the transmit bar. The leg is normally positioned between a stationary bracket and the transmit bar to prevent the latter from being depressed. When the monitor button is depressed, a cam thereon shifts the spring leg about the axis of the spring and clear of blocking position with respect to the transmit bar. Any bend in, or flexing of, the spring leg may defeat its locking operation. Further, the coil and cooperating parts are more difficult to assemble, and thus maintenance and repair are quite a problem, especially since all operating parts, switches and the like are carried by a cover housing and connections are not readily accessible.

In contrast, my invention utilizes a simple lever which is pivoted to the base of the microphone. Also carried by the base, and readily accessible when the cover housing is removed, are the required switches and the pivotal mounting for the transmit bar and monitor button. Further, the monitor button is locked in a simple manner in my invention, as opposed to a latching spring required in the prior art device.

DESCRIPTION OF THE DRAWINGS

In the drawings accompanying this specification and forming a part of this application there is shown, for purpose of illustration, an embodiment which my invention may assume and in these drawings:

FIG. 5 is a fragmentary sectional view corresponding to the line 5—5 of FIG. 3, showing the monitor button in unlocked position, the monitor button and a switch cooperable therewith being shown in elevation, FIG. 6 is a view similar to FIG. 5 but showing the monitor button in locked position, the monitor button and a switch cooperable therewith being shown in elevation, FIG. 7 is a fragmentary sectional view corresponding to the line 7—7 of FIG. 8, FIG. 8 is a sectional view corresponding to the line 8—8 of FIG. 5, FIG. 9 is a fragmentary perspective view, showing the transmit bar and the monitor button in separated relation, FIGS. 10 and 11 are fragmentary views, partly in elevation and partly in section, showing the transmit bar and locking lever in two relative positions, FIG. 12 is a fragmentary sectional view corresponding to the line 12—12 of FIG. 3, FIG. 13 is transverse sectional view corresponding to the line 13—13 of FIG. 12, and FIG. 14 is a schematic electrical diagram of various components.

DESCRIPTION OF THE PREFERRED EMBODIMENT

Figure 1:
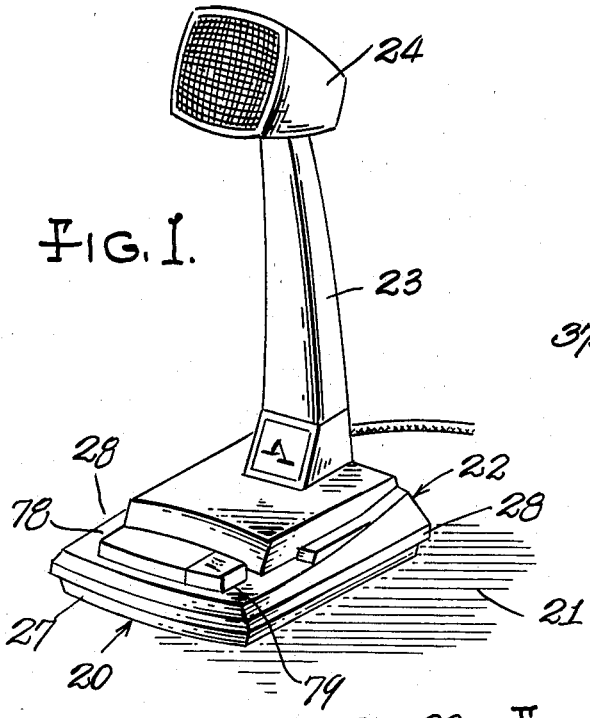
FIG. 1 is a perspective view of a base station microphone incorporating my invention.

As seen in FIG. 1, the embodiment of the invention herein disclosed comprises a base 20 formed of a rigid material, such as metal, and adapted to be supported on a work surface, such as a desk or table top 21. A housing cover 22, preferably of rigid plastic, is detachably connected to the base to overlie the latter, the cover having an upstanding hollow neck 23 with a hollow head 24 at its upper end. The head contains the microphone assembly (not shown) in conventional manner, and an electrical cord C extends through the neck 23 from the head 24 to the interior of the housing 22 in known manner, and for known purposes.

Figure 2:
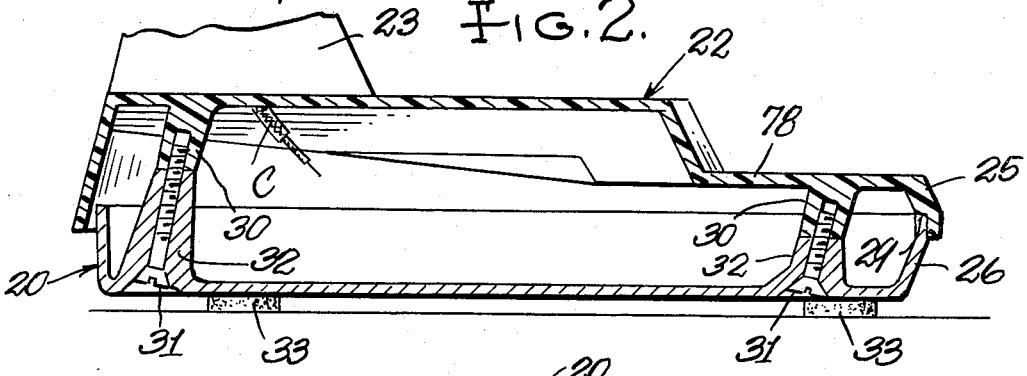
FIG. 2 is a fragmentary sectional view corresponding to the line 2—2 of FIG. 3.
Figure 3:
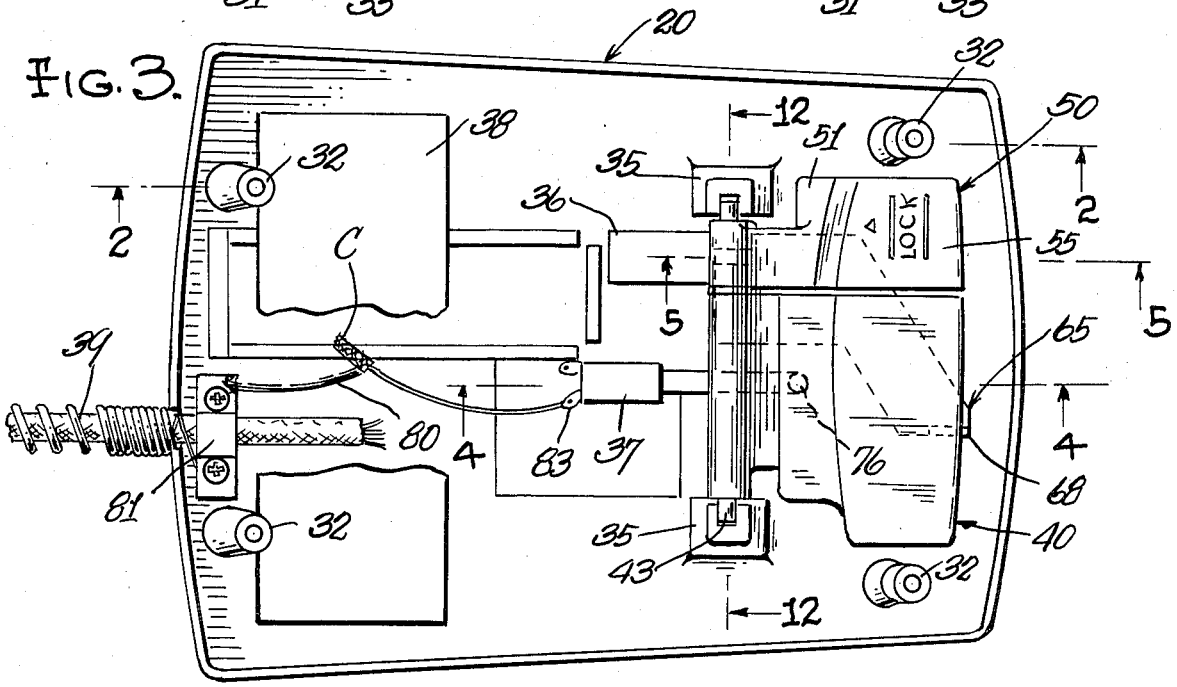
FIG. 3 is a plan view looking into the base when the cover housing is removed.

As seen in FIG. 2 the housing 22 has a horizontally-disposed flange 25 which overlies and overlaps a vertically peripheral flange 26 of the base 20. At the front 27 and two sides 28, the flanges 25 and 26 have abutting shoulders 29 to fix the housing and base relative to each other in a vertical manner, and to align the same in a horizontal manner. As best seen in FIGS. 2 and 3, the housing 22 has bosses 30 at its four corner areas which have threaded openings adapted to receive screws 31 which pass through openings in corresponding bosses 32 which extend upwardly from the base 20. The base has rubber buttons 33 extending from its lower surface to prevent marring of the finish of the support surface 21. As seen in FIG. 2, the respective pairs of bosses 30,32 have facing surfaces which abut to assist the shoulders 29 in predetermining the position of the housing 22 vertically relative to the base 20.

As seen in FIG. 3, all cooperating parts are carried by the base 20, and nothing but the neck 23 is carried by the housing cover 22, so that when the screws 31 are removed, the housing may be lifted from the base, and all of the cooperating parts are exposed and readily accessible. Some of the parts visible in FIG. 3 are the pivot posts 35,35 which are integral with and extend upwardly from the base 20; the transmit bar and monitor button which may be lifted from the pivot posts for further access to parts; the monitor switch 36 and the leaf switch 37, the latter operated by the transmit bar; the base weight 38 which provides stability to the base microphone; the service cable 39; and other parts.

The transmit bar 40 is preferably formed of rigid plastic material and, as best seen in FIG. 9, comprises a hollow rectangular-like finger portion 41 having an integral ear 42 to receive a pivot shaft 43. The ear 42 has a rib 44 for reinforcing purposes. The forward part of the finger portion 41 has a vertically-extending wall 45 with a rectangular recess 46 opening from the bottom rectilinear margin 47 of the wall 45. The shaft 43 is preferably fixed within an opening in the ear 42 against axial and rotative movement so it is not displaced from the transmit bar 40.

The monitor button 50 is also preferably formed of rigid plastic material and, as seen in FIGS. 5 through 9, comprises a hollow base portion 51 which has an integral ear 52 formed with an opening 53 to closely but rotatably receive an end portion 54 of the pivot shaft 43 so that the monitor button may rotate relative to the transmit bar. For a purpose to appear, the monitor botton 50 further comprises a finger portion 55 mounted on the top surface of the base portion for sliding movement in a direction transverse to the axis of the pivot shaft 43.

In the embodiment disclosed, the finger portion 55 has a downwardly-extending web 56 which is longitudinally recessed at 57 to provide spring fingers, the headed extremities of which may be snapped through a slot 59 in the top surface of the bar portion 51. A rear surface of the finger portion 55 has a horizontal slot 58 for a purpose to appear.

The monitor button 50 may be mounted on the shaft end 54 and the button and transmit bar 40 may be moved as a unit to assembled position within the base 20 and upon the pivot posts 35. As best seen in FIGS. 9, 12 and 13, the pivot posts 35,35 are formed with upwardly opening bearing recesses 60 to closely receive the opposite ends of the pivot shaft 43. To hold the shaft against dislodgement from the recesses 60 in the pivot posts 35, ribs 61 (see FIGS. 12 and 13) extend downwardly from the inner surface of the housing cover 22 and press against the shaft ends. The ribs are rectilinear to have line contact with the shaft 43 so as to minimize friction.

A lock lever 65 is pivotally mounted on the inside surface of the base 20 and is adapted to lock pivotal movement of the transmit bar 40 unless the monitor button 50 has been depressed. Referring particularly to FIGS. 3, 10 and 11, the lever is formed as a sheet metal stamping, and a screw and washer arrangement 66 releasably holds the lever flatwise against the inner surface of the base 20, but permits free rotation of the lever about the pivot formed by the screw and washer arrangement. The lever has upstanding ears 67,68 at its short and long arms, respectively. The ear 67 is engaged by a rib 69 which extends from and is preferably integral with the base portion 51 of the monitor button 50.

The rib 69 is adapted to press the lever ear 67 against a plunger 70 of the monitor switch 36, the latter being releasably mounted on, and extending upwardly from, the inner surface of the base 20. The plunger 70 is spring pressed in a direction outwardly of the monitor switch 36, as suggested in FIG. 10. With the plunger 70 in fully-extended position, lever ear 67 and monitor button rib 69 hold the monitor button in the substantially horizontal position shown in FIG. 5. The spring action of the switch plunger 70 urges the lock lever 65 to the position shown in FIG. 10, wherein the lever ear 68 underlies the lower margin of the vertically-extending wall 45 of the transmit bar, as suggested in FIGS. 9 and 10, to thereby block downward movement of the transmit bar.

When the monitor button 50 is depressed, it swings about the shaft 43 so as to press the rib 69 against the lever ear 69 and in turn press the latter against the switch plunger 70 to cause the plunger to move inward of the monitor switch 36 and actuate its contacts to permit a check for a clear transmission channel. Downward movement of the monitor button 50 simultaneously causes flatwise swinging movement of the lock lever 65 about its pivot 66 to move the lever ear 68 to the position shown in FIG. 11. In this position, the lever ear 68 is disposed in line with the recess 46 in the wall 45 of the transmit bar 40, whereby the latter may be depressed by downward finger pressure.

Figure 4:
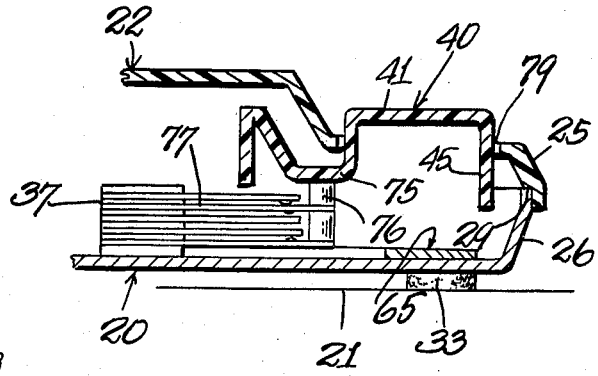
FIG. 4 is a fragmentary sectional view corresponding to the line 4—4 of FIG. 3.

Depression of the transmit bar 40 causes it to swing about the axis defined by the shaft 43, whereby a portion 75 (see FIG. 4) thereof presses downwardly against an insulating button 76 carried by a leaf 77 of the leaf switch 37 to affect contacts of the latter and close an electrical circuit to permit microphone transmission.

As seen in FIGS. 1, 2, 4, 5 and 6, the housing cover 22 has a horizontal ledge 78 provided with an opening 79 large enough to permit portions of the transmit bar 40 and monitor button 50 to project freely therethrough. If it is desired to lock the monitor button in its depressed position wherein the transmit bar is free to be depressed at will, the finger portion 55 of the monitor button is bodily shifted by the finger of a user in a direction to bring the slot 58 in position to receive a marginal portion defining the ledge opening 79.

With the attaching screws 31 removed, the cover housing 22 may be lifted from the base 20 and disposed alongside thereof, the only connection being the flexible conductor C which has part of its metallic sheath 80 (see FIG. 3) soldered to the metal clip 81 which holds the supply conductor 39. One end of the conductor C is soldered to a connector terminal 83 of the leaf switch 37, and the other end is electrically connected to the microphone head in conventional manner. Thus, the housing cover 22 may be removed and disposed in any place closely adjacent to the base 20, since the cover does not carry any of the switches and other operating and necessary parts of the microphone operating assembly, and the cover at this time is connected to the base only by the flexible cord C. These operating parts as seen in FIG. 3 are all carried by the base 20 and are freely accessible through the upper opening thereof. The shaft 43 and the transmit bar 40 and monitor button 50 may be bodily lifted from the pivot posts 35,35 to provide further access to operating parts. Thus, assembly, maintenance and repairs are a simple matter.

I claim:

1. A base station microphone comprising, a transmit bar movable from one position to a second position and in the latter position adapted to permit sound transmission via the microphone, a monitor button movable from one position to a second position, and interlock means between said transmit bar and said monitor button wherein said transmit bar is held against movement to its said second position until said monitor button is moved to its said second position, said interlock means comprising a lever having an abutment on one leg positioned for contact with a portion of said monitor button, and an abutment on another lever leg positioned for contact with a portion of said transmit bar and adapted to prevent movement of the latter to its said second position, movement of said monitor button to its said second position swinging said lever to withdraw the abutment on said lever other leg from interference with movement of said transmit bar to its said second position.

2. A base station microphone comprising, a transmit bar movable from one position to a second position and in the latter position adapted to permit sound transmission via the microphone, a monitor button movable from one position to a second position, interlock means between said transmit bar and said monitor button whereby said transmit bar is held against movement to its said second position until said monitor button is moved to its said second position, a monitor switch having a housing and switch contacts within said housing and an operating plunger movable through an opening in said switch housing between inner and outer positions, and spring pressed to said outer position, said monitor button having a portion engageable with said plunger in manner whereby said monitor button is urged to its one position by spring pressure acting on said plunger.

3. The construction according to claim 2 wherein said monitor button has a base portion and a finger portion shiftably mounted on said base portion, said finger portion in one position locking said monitor button in its said second position.

4. The construction according to claim 2 and further including a transmit bar switch having a portion engageable with said transmit bar to yieldably hold the latter in its said one position.

5. A base station microphone, comprising:

a base adapted to rest upon a support surface, such as a table, a housing cover overlying said base and extending upwardly therefrom and supporting a head which contains the electroacoustic transducer of the microphone, said housing cover and said base being connected to form an enclosure, a pair of pivot posts connected to and extending upwardly from said base, a pivot shaft having ends journalled within openings in said posts, a transmit bar and a monitor button carried by said shaft for rotation, said housing cover having an opening to pass portions of said transmit bar and said monitor button so that said portions are accessible to an operator, interlock means between said transmit bar and said monitor button wherein said transmit bar is held against rotation in a direction inwardly of said enclosure until said monitor button has been rotated in a direction inwardly of said enclosure, said interlock means comprising a flat sheet metal stamping which provides a bell crank lever, said lever being pivoted flatwise to the inner surface of said base, one leg of said lever having an upwardly bent ear adapted to be engaged by a portion of said monitor button and the other leg of said lever having an upwardly bent ear adapted to be engaged by said transmit bar, rotation of said monitor button in a direction inwardly of said enclosure pressing said button portion against the ear on said one lever leg to in turn rotate said lever and thereby withdraw the ear on said other lever leg from interference with rotation of said transmit bar in a direction inwardly of said enclosure.

6. The construction according to claim 5 wherein said ear on said one leg is disposed between said monitor button portion and a spring pressed plunger of a monitor switch, the construction and arrangement being such that said spring pressed plunger yieldably opposes rotation of said monitor button in a direction inwardly of said enclosure.

7. The construction according to claim 5 wherein a transmit bar switch has a resilient portion adapted to yieldably oppose movement of said bar in a direction inwardly of said enclosure.

8. A base station microphone, comprising:

hollow base means enclosing operating parts such as a transmit bar, a monitor button, a monitor switch, a leaf switch, and the like, said base means comprising a base adapted to rest upon a support surface, such as a table, and a housing cover overlying said base and extending upwardly therefrom and supporting a head which contains the electroacoustic transducer of the microphone, said housing cover and said base forming said hollow base means and having separable interconnection, said base supporting and having connected thereto substantially all of said operating parts so that when said housing cover is removed therefrom, said parts are exposed, said housing cover having an opening through which portions of said transmit bar and said monitor button extend for manipulation by the fingers of an operator, said transmit bar being supported for movement from one position to a second position and in the latter position permitting sound transmission via the microphone, said monitor button being supported for movement from one position to a second position, and interlock means between said transmit bar and said monitor button wherein said transmit bar is held against movement to its said second position until said monitor button is moved to its said second position, said interlock means comprising a lever having an abutment on one leg positioned for contact with a portion of said monitor button, and an abutment on another lever leg positioned for contact with a portion of said transmit bar and adapted to prevent movement of the latter to its said second position, movement of said monitor button to its said second position swinging said lever to withdraw the abutment on said lever other end from interference with movement of said transmit bar to its said second position.

9. A base station microphone, comprising:

hollow base means enclosing operating parts, such as a transmit bar, a monitor button, a monitor switch, a leaf switch and the like, said base means comprising a base adapted to rest upon a support surface, such as a table, and a housing cover overlying said base and extending upwardly therefrom and supporting a head which contains the electroacoustic transducer of the microphone, said housing cover and said base forming said hollow base means and having separable interconnection, said base supporting and having connected thereto substantially all of said operating parts so that when said housing cover is removed therefrom, said parts are exposed, said housing cover having an opening through which portions of said transmit bar and said monitor button extend for manipulation by the fingers of an operator, said transmit bar and said monitor button being carried by a shaft and said base having a pair of upstanding pivot posts, each having an upwardly opening pivot socket formed in its upper end, said sockets removably receiving respective ends of said shaft whereby the latter and said transmit bar and said monitor button may be lifted as a unit from said sockets when said housing cover is removed from said base, said housing cover having portions overlying said sockets when said housing cover is connected to said base, said portions preventing removal of said shaft ends from said sockets.

* * * * *